US009618012B2

(12) United States Patent
Tsutsui

(10) Patent No.: US 9,618,012 B2
(45) Date of Patent: Apr. 11, 2017

(54) TURBO-MOLECULAR PUMP

(71) Applicant: SHIMADZU CORPORATION, Kyoto (JP)

(72) Inventor: Shingo Tsutsui, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 308 days.

(21) Appl. No.: 14/587,359

(22) Filed: Dec. 31, 2014

(65) Prior Publication Data

US 2015/0219116 A1 Aug. 6, 2015

(30) Foreign Application Priority Data

Feb. 5, 2014 (JP) ..... 2014-020364

(51) Int. Cl.
*F04D 29/58* (2006.01)
*F04D 19/04* (2006.01)

(52) U.S. Cl.
CPC ..... *F04D 29/584* (2013.01); *F04D 19/042* (2013.01); *F04D 19/044* (2013.01)

(58) Field of Classification Search
CPC .... F04D 29/584; F04D 19/042; F04D 19/044; F04D 29/5853; F04D 19/046; F04D 19/04; F01D 11/24
USPC ..... 415/175, 47, 90, 143; 417/423.4
See application file for complete search history.

(56) References Cited

U.S. PATENT DOCUMENTS 6,793,466 B2 * 9/2004 Miyamoto ..... F04D 29/584 415/177

FOREIGN PATENT DOCUMENTS

JP 2003-278692 10/2003

OTHER PUBLICATIONS

Chinese Office Action dated Aug. 12, 2016 for corresponding Chinese Application No. 201410721317.4 (English translation).

* cited by examiner

*Primary Examiner* — Ninh H Nguyen
*Assistant Examiner* — Aaron R Eastman
(74) *Attorney, Agent, or Firm* — Renner, Otto, Boisselle & Sklar, LLP

(57) ABSTRACT

A turbo-molecular pump comprises a rotor having rotor blades and a cylindrical section; stationary blades; a plurality of spacers; a stator arranged with a gap from the cylindrical section, a base; a spacer cooling section arranged between a lowest spacer of the stacked spacers and the base, the spacer cooling section having a first flow passage through which coolant flows; a heater for heating the stator; a temperature sensor for detecting a temperature of the stator; a base cooling section for cooling the base, the base cooling section having a second flow passage connected in series to the first flow passage; and a temperature controller for controlling circulation of coolant to the first flow passage and the second flow passage connected in series and energization of the heater to maintain the temperature of the stator at a predetermined temperature.

4 Claims, 10 Drawing Sheets

TURBO-MOLECULAR PUMP

BACKGROUND OF THE INVENTION

1. Field of the Invention

The present invention relates to a turbo-molecular pump that is used in vacuum apparatuses such as a semiconductor manufacturing apparatus and an analysis apparatus, in a pressure range from medium vacuum through ultra-high vacuum.

2. Description of the Related Art

Conventionally, in a dry etching process, a CVD process, or the like in semiconductor manufacturing processes, processing is performed while supplying a large amount of gas in order to perform the processes at high speed. Generally, a turbo-molecular pump that is provided with a turbine blade section and a screw groove pump section is used as a vacuum pump that evacuates a process chamber in a semiconductor manufacturing apparatus that performs these processes. When the turbo-molecular pump is used in these processes, a reaction product may be accumulated inside the pump depending on the type of process gas. In particular, the reaction product is likely to be accumulated on the screw groove pump section having a relatively high pressure because of the relationship between the pressure and the sublimation temperature in the reaction product.

Thus, in a turbo-molecular pump described in JP 2003-278692 A, a heater and a water-cooled pipe are disposed on a pump base, and energization of the heater and supply of cooling water are controlled to thereby monitor the temperature of a gas flow passage in a screw stator or the like so as not to drop to a preset temperature or less. This prevents accumulation of a reaction product.

A turbo-molecular pump discharges gas by rotating a rotor at high speed. Generally, an aluminum alloy is used in the rotor. A temperature at which a creep phenomenon occurs in aluminum is lower than that in other metals. Thus, in a turbo-molecular pump in which a rotor rotates at high speed, it is necessary to suppress the temperature of the rotor lower than a creep temperature range.

On the other hand, when a large amount of gas is discharged in the turbo-molecular pump, heat is generated in response to the gas discharge, which results in an increase in the temperature of the rotor. Heat release from the rotor is mainly performed by radiation from rotor blades to stationary blades or heat transfer through gas. However, as described above, in the configuration which controls energization of the heater and supply of cooling water to maintain the temperature of the screw stator or the like higher than the preset temperature, the temperature of the stationary blades during gas discharge becomes higher than the temperature of the screw stator. Accordingly, heat release from the rotor blades to the stationary blades is not sufficiently performed, and the temperature of the rotor is thus likely to increase. Therefore, disadvantageously, it is not possible to increase the exhaust flow rate.

SUMMARY OF THE INVENTION

A turbo-molecular pump comprises: a rotor having a plurality of stages of rotor blades and a cylindrical section; a plurality of stages of stationary blades alternately arranged with respect to the plurality of stages of rotor blades; a plurality of spacers stacked to position the plurality of stages of stationary blades; a stator arranged with a gap from the cylindrical section, a base to which the stator is fixed; a spacer cooling section arranged between a lowest spacer of the stacked spacers and the base so as to be in contact with the lowest spacer, the spacer cooling section having a first flow passage through which coolant flows; a heater for heating the stator; a temperature sensor for detecting a temperature of the stator; a base cooling section for cooling the base, the base cooling section having a second flow passage connected in series to the first flow passage; and a temperature controller for controlling circulation of coolant to the first flow passage and the second flow passage connected in series and energization of the heater to maintain the temperature of the stator at a predetermined temperature.

An outflow section of the second flow passage is connected to an inflow section of the first flow passage to allow coolant to circulate from the second flow passage to the first flow passage.

An outflow section of the first flow passage is connected to an inflow section of the second flow passage to allow coolant to circulate from the first flow passage to the second flow passage.

The turbo-molecular pump further comprises: a bypass pipe connected in parallel to the first flow passage and the second flow passage connected in series; and a three-way valve for alternatively switching a first circulation state in which coolant circulates to the first flow passage and the second flow passage and a second circulation state in which coolant circulates to the bypass pipe. The temperature controller controls energization of the heater and switching between the first circulation state and the second circulation state performed by the three-way valve to maintain the temperature of the stator at the predetermined temperature.

According to the present invention, it is possible to achieve both exhaust with a large flow rate and prevention of reaction product accumulation.

DETAILED DESCRIPTION OF PREFERRED EMBODIMENT

Figure 1:
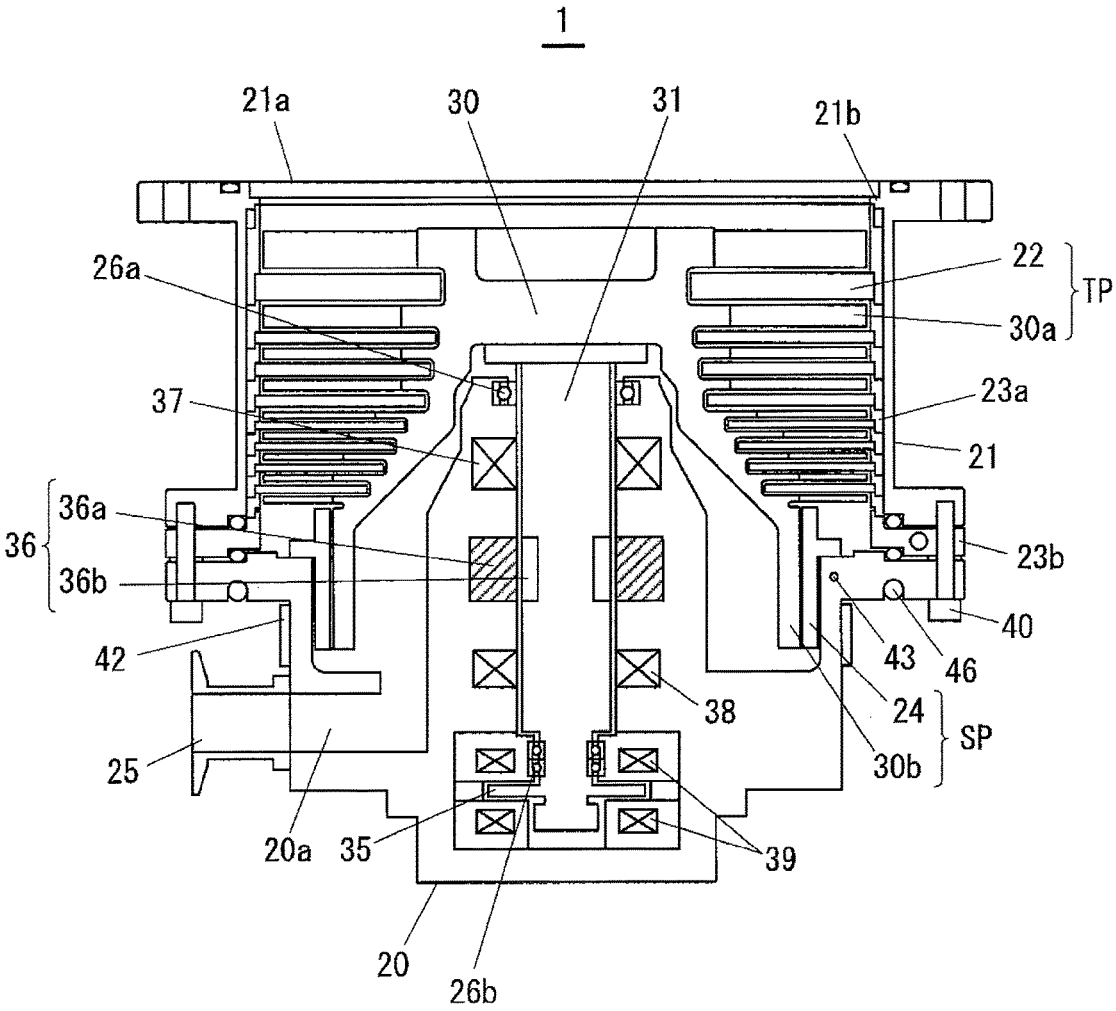
FIG. 1 is a cross-sectional view showing a schematic configuration of a pump unit 1 of a turbo-molecular pump according to the present invention.

Hereinafter, an embodiment of the present invention will be described with reference to the drawings. FIG. 1 is a diagram illustrating an embodiment of a turbo-molecular pump according to the present invention, specifically, a cross-sectional view showing a schematic configuration of a pump unit 1 of the turbo-molecular pump. The turbo-molecular pump is provided with the pump unit 1 shown in FIG. 1, a control unit (not shown) for controlling the drive of the pump unit 1, and a temperature regulation controller 51 (not shown, refer to FIG. 4) which will be described below.

In the following description, an active magnetic bearing turbo-molecular pump will be described as an example. However, the present invention can also be applied, for example, to passive magnetic bearing turbo-molecular pumps using a permanent magnet or turbo-molecular pumps using a mechanical bearing.

A rotor 30 has a plurality of stages of rotor blades 30*a* and a cylindrical section 30*b* which is formed on an exhaust downstream side with respect to the rotor blades 30*a*. The rotor 30 is fastened to a shaft 31 as a rotor shaft. The rotor 30 and the shaft 31 together constitute a pump rotor body. The shaft 31 is supported in a contactless manner by magnetic bearings 37, 38, and 39 which are disposed on a base 20. Electromagnets of the axial magnetic bearing 39 are arranged so as to sandwich a rotor disk 35 which is disposed on a lower end of the shaft 31 in an axial direction.

The pump rotor body (the rotor 30 and the shaft 31) which is magnetically levitated in a freely rotatable manner by the magnetic bearings 37 to 39 is driven to rotate at high speed by a motor 36. For example, a three-phase blushless motor is used as the motor 36. A motor stator 36*a* of the motor 36 is disposed on the base 20, and a motor rotor 36*b* which is provided with a permanent magnet is disposed on the shaft 31. Emergency mechanical bearings 26*a* and 26*b* support the shaft 31 when the magnetic bearings are not operating.

A plurality of stages of stationary blades 22 are each arranged between the vertically adjacent rotor blades 30*a*. The stationary blades 22 are positioned on the base 20 by a plurality of spacers 23*a* and a cooling spacer 23*b*. Each of the stationary blades 22 is sandwiched by the spacers 23*a*. The cooling spacer 23*b* is arranged between the lowest one of the stacked spacers 23*a* and the base 20. A detailed configuration of a portion in which the cooling spacer 23*b* is arranged will be described below. When a case 21 is fixed to the base 20 with bolts 40, a stacked body of the stationary blades 22, the spacers 23*a*, and the cooling spacer 23*b* is sandwiched between an upper end locking section 21*b* of the case 21 and the base 20. As a result, the stationary blades 22 are positioned in the axial direction (vertical direction in the drawing).

The turbo-molecular pump shown in FIG. 1 is provided with a turbine blade section TP which includes the rotor blades 30*a* and the stationary blades 22 and a screw groove pump section SP which includes the cylindrical section 30*b* and a screw stator 24. Although a screw groove is formed on the screw stator 24 in the present embodiment, the screw groove may be formed on the cylindrical section 30*b*. An exhaust port 25 is attached to an exhaust opening 20*a* of the base 20. A back pump is connected to the exhaust port 25. By driving the rotor 30 to rotate at high speed by the motor 36 while magnetically levitating the rotor 30, gas molecules in a suction opening 21*a* are discharged toward the exhaust port 25.

A base cooling pipe 46, a heater 42, and a temperature sensor 43 for controlling the temperature of the screw stator 24 are disposed on the base 20. The temperature control for the screw stator 24 will be described below. In the example shown in FIG. 1, the heater 42 which is configured of a band heater is wound around a side face of the base 20. However, a sheathed heater may be embedded in the base 20, or disposed on the screw stator 24. The temperature sensor 43 is provided for measuring the temperature of the screw stator 24. In the example shown in FIG. 1, the temperature sensor 43 is disposed on the base 20 to indirectly obtain the temperature of the screw stator 24. However, it is possible to more accurately measure the screw stator temperature by disposing the temperature sensor 43 on the screw stator 24. As the temperature sensor 43, for example, a thermistor, a thermocouple, or a platinum temperature sensor is used.

Figure 2:
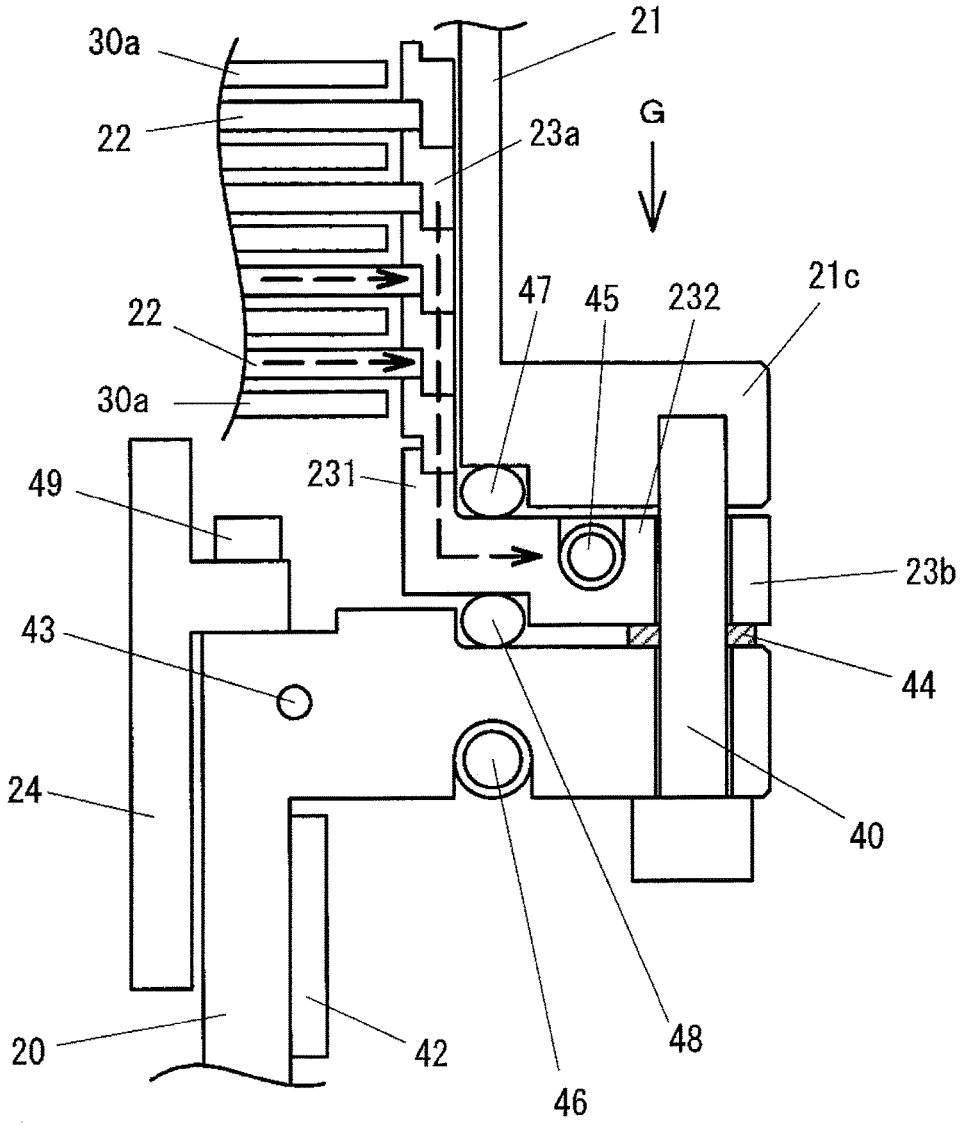
FIG. 2 is an enlarged view of a portion in which a cooling spacer 23*b* is disposed in FIG. 1.

FIG. 2 is an enlarged view of the portion in which the cooling spacer 23*b* is disposed in FIG. 1. As described above, the stacked body formed by alternately stacking the stationary blades 22 and the spacers 23*a* on each other is mounted on the cooling spacer 23*b*. The cooling spacer 23*b* includes a flange section 232 in which a spacer cooling pipe 45 is provided and a spacer section 231 on which the lowest spacer 23*a* is mounted.

Figure 3:
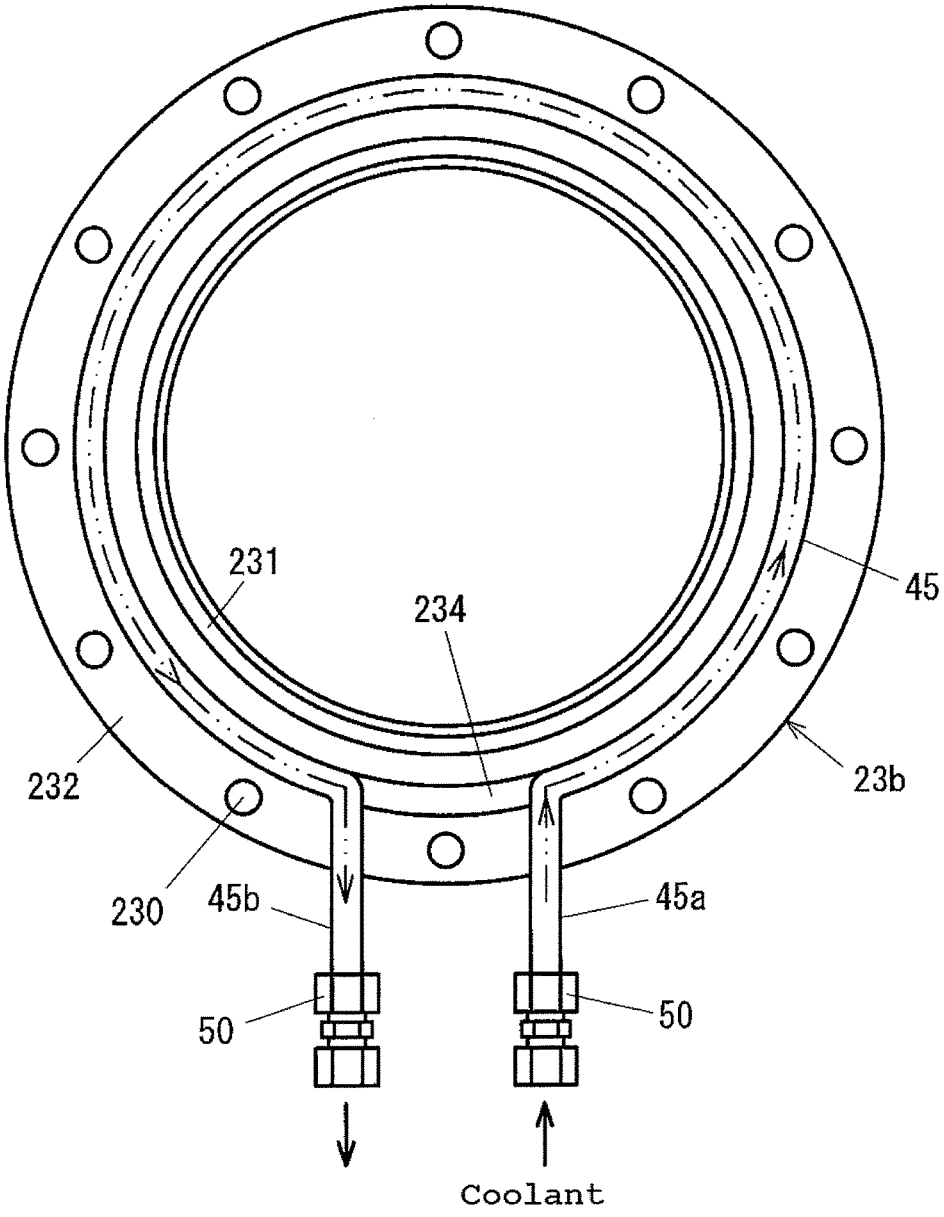
FIG. 3 is a plan view of the cooling spacer 23*b* of FIG. 2 viewed from a direction G.

FIG. 3 is a plan view of the cooling spacer 23*b* of FIG. 2 viewed from a direction G. As with the spacers 23*a*, the cooling spacer 23*b* is a ring-like member. A circular groove 234 which houses the spacer cooling pipe 45 is formed on the flange section 232. A plurality of through holes 230 which allow the bolts 40 (refer to FIGS. 1 and 2) to pass therethrough are formed on the outer peripheral side of the groove 234. A gap between the spacer cooling pipe 45 and the groove 234 is filled with thermal conductive grease, high thermal conductive resin, solder, or the like.

The spacer cooling pipe 45 is bent into a generally circular shape, so that an inflow section 45*a* and an outflow section 45*b* of the spacer cooling pipe 45 are extracted to a lateral side of the cooling spacer 23*b*. A piping joint 50 is attached to each of the inflow section 45*a* and the outflow section 45*b*. Coolant (cooling water, for example) flows into the spacer cooling pipe 45 from the inflow section 45*a*, then circularly flows along the spacer cooling pipe 45, and is then discharged from the outflow section 45*b*.

Referring back to FIG. 2, the case 21 is attached so that a flange 21*c* faces the flange section 232 of the cooling spacer 23*b*, and fixed to the base 20 with the bolts 40. Heat insulation washers 44 each of which functions as a heat insulation member are disposed on the respective bolts 40. The heat insulation washers 44 are arranged between the base 20 and the cooling spacer 23*b* to thermally insulate the base 20 and the cooling spacer 23*b* from each other. As the material used in the heat insulation washers 44, a material having a thermal conductivity that is lower than the thermal conductivity of the material used in the spacers 23*a* and the cooling spacer 23*b* (aluminum, for example) is used. For example, stainless steel is desirably used among metals. On the other hand, a resin having a heat resistant temperature of 120° C. or higher (an epoxy resin, for example) is desirably used among nonmetals.

A vacuum seal 48 is disposed between the flange section 232 of the cooling spacer 23*b* and the base 20. Also, a vacuum seal 47 is disposed between the flange section 232 and the flange 21*c*. The base 20 is heated by the heater 42, and cooled by the base cooling pipe 46 through which coolant flows. The screw stator 24 is fixed to the base 20 with bolts 49 and is in thermal contact with the base 20. Accordingly, the screw stator 24 is cooled by the base cooling pipe 46 through the base 20, and heated by the heater 42. The temperature sensor 43 is arranged on the base 20 near a position to which the screw stator 24 is fixed.

The cooling spacer 23*b* is cooled by coolant flowing inside the spacer cooling pipe 45. Thus, heat of the stationary blades 22 is first transferred to the spacers 23*a* and then to the cooling spacer 23*b* as indicated by broken line arrows and released into the coolant inside the spacer cooling pipe 45. Although details will be described below, in discharge of gas producing a reaction product that is likely to be accumulated, heating performed by the heater 42 and cooling performed by the base cooling pipe 46 are controlled to make the temperature of the screw stator 24 equal to or higher than a temperature that does not cause accumulation of the reaction product. As the temperature that does not cause the accumulation of the reaction product, a temperature equal to or higher than the sublimation temperature of the reaction product is employed.

Therefore, the heat insulation washers 44 are arranged between the cooling spacer 23*b* and the base 20 to prevent heat from flowing toward the stationary blades 22 from the base 20 in a high temperature state. Further, as can be seen from FIG. 2, a gap is formed between the cooling spacer 23*b* and the flange 21*c* through the vacuum seal 47. Thus, heat transfer between the case 21 and the cooling spacer 23*b* is reduced.

Figure 4:
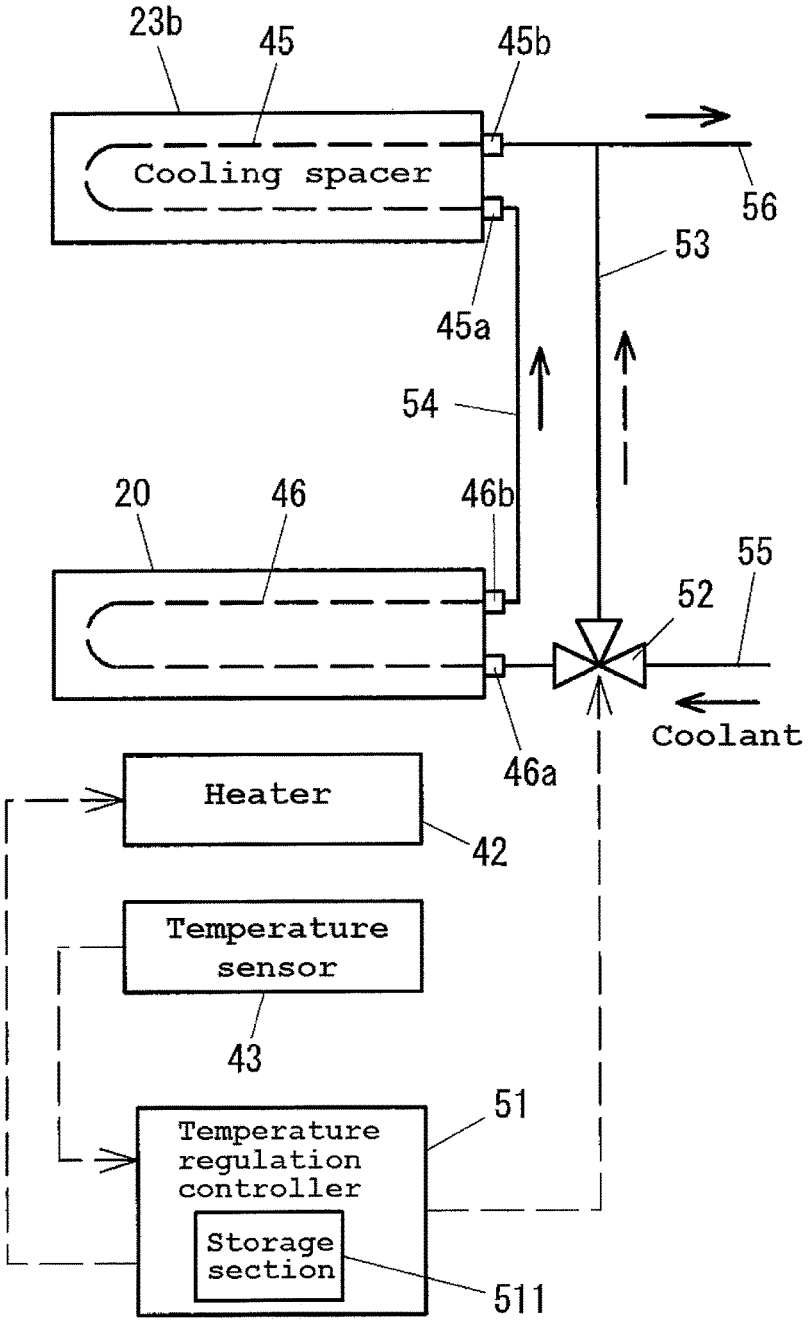
FIG. 4 is a block diagram illustrating the relationship between a temperature regulation system and the cooling spacer 23*b;*

FIG. 4 is a block diagram illustrating the relationship between a temperature regulation system and the cooling spacer 23*b*. The temperature regulation system includes the base cooling pipe 46, the heater 42, the temperature sensor 43, the temperature regulation controller 51, a three-way valve 52, and a bypass pipe 53. The spacer cooling pipe 45 of the cooling spacer 23*b* is connected in series to the base cooling pipe 46 through a pipe 54. That is, the pipe 54 connects an outflow section 46*b* of the base cooling pipe 46 and the inflow section 45*a* of the spacer cooling pipe 45 to each other.

The three-way valve 52 is disposed on a coolant supply pipe 55 which is connected to the inflow section 46*a* of the base cooling pipe 46. The inflow section 46*a* is connected to one discharge port of the three-way valve 52, and the bypass pipe 53 is connected to the other discharge port of the three-way valve 52. An end of the bypass pipe 53, the end not being connected to the three-way valve 52, is connected to a coolant return pipe 56 which is connected to the outflow section 45*b* of the spacer cooling pipe 45. That is, the bypass pipe 53 is connected in parallel to the spacer cooling pipe 45 and the base cooling pipe 46 which are connected in series.

By switching the three-way valve 52, coolant is supplied to either a path of the spacer cooling pipe 45 and the base cooling pie 46 connected in series, or the bypass pipe 53. The switching of the three-way valve 52 is controlled by the temperature regulation controller 51. The temperature regulation controller 51 controls the switching of the three-way valve 52 and ON/OFF of the heater 42 based on a temperature detected by the temperature sensor 43 and a preset temperature stored in a storage section 511. Although the temperature regulation controller 51 is provided separately from the control unit in the example shown in FIG. 4, the temperature regulation controller 51 may be built in the control unit. Further, the control performed by the temperature regulation controller 51 may be performed by a controller of a vacuum apparatus to which the turbo-molecular pump is attached.

(Detailed Description for Temperature Control)

Next, the temperature control performed by the temperature regulation controller 51 (hereinafter, referred to as "temperature regulation control") will be described. When the turbo-molecular pump is used in a vacuum apparatus that performs a process that is likely to cause accumulation of a chloride or fluorine sulfide reaction product, temperature regulation control as described below is performed in order to prevent the reaction product from being accumulated inside the pump. As the degree of vacuum decreases (that is, as the pressure increases), the sublimation temperature of a chloride or fluorine sulfide reaction product increases, and the chloride or fluorine sulfide reaction product is thus more likely to be accumulated.

Figure 5:
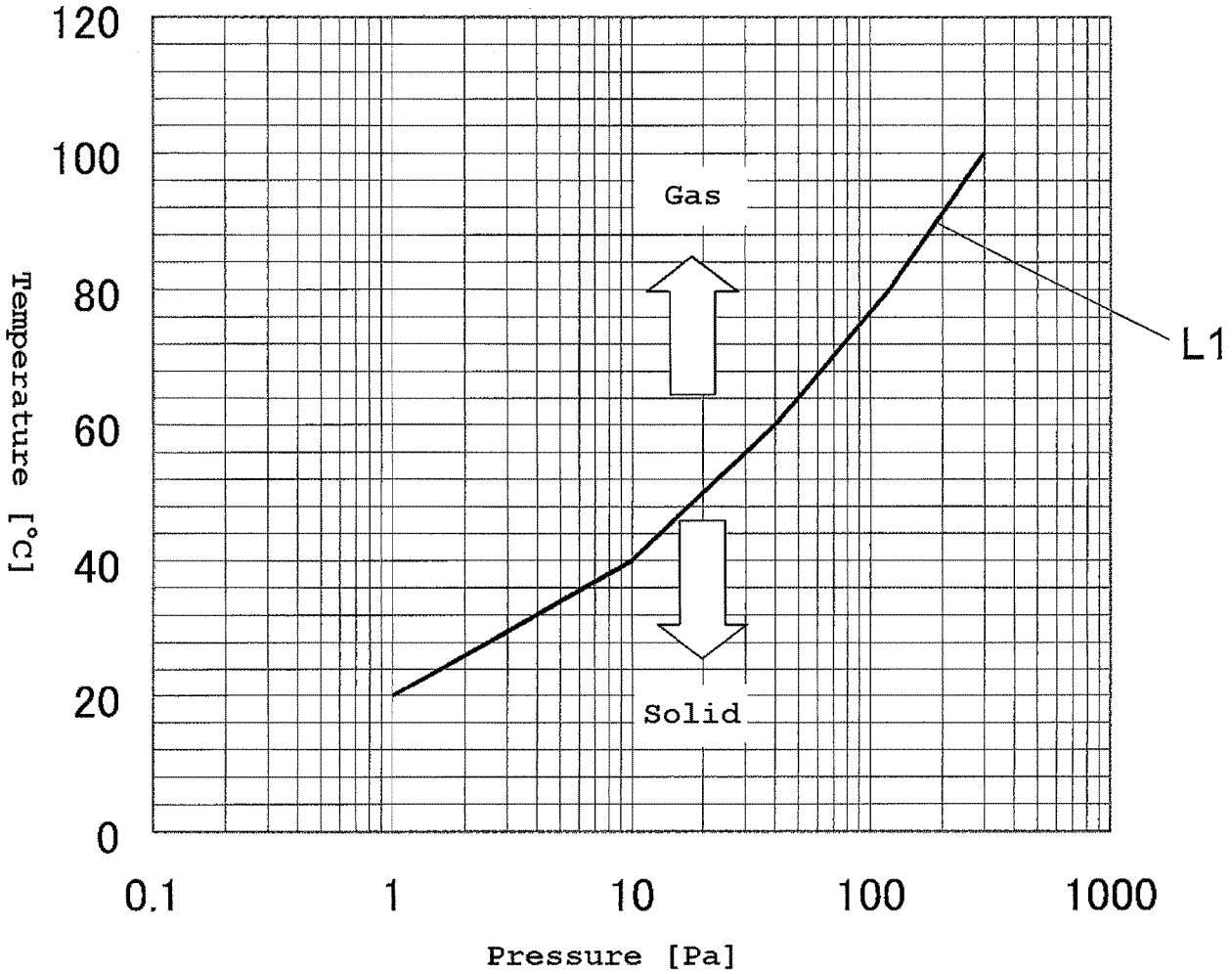
FIG. 5 is a diagram showing a vapor pressure curve of aluminum chloride.

For example, when the reaction product is aluminum chloride, a vapor pressure curve of aluminum chloride forms a curve L1 as shown in FIG. 5. In FIG. 5, the vertical axis represents the sublimation temperature (° C.) and the horizontal axis represents the pressure (Pa). Aluminum chloride is in a gaseous state above the curve L1, but in a solid state below the curve L1. As can be seen from FIG. 5, as the pressure increases, the sublimation temperature increases. Thus, the reaction product is more likely to be accumulated on the more downstream side of the pump, specifically, on the screw groove pump section SP (the cylindrical section 30*b* and the screw stator 24). Therefore, in the present embodiment, the temperature regulation control is performed to prevent reaction product accumulation.

Figure 6:
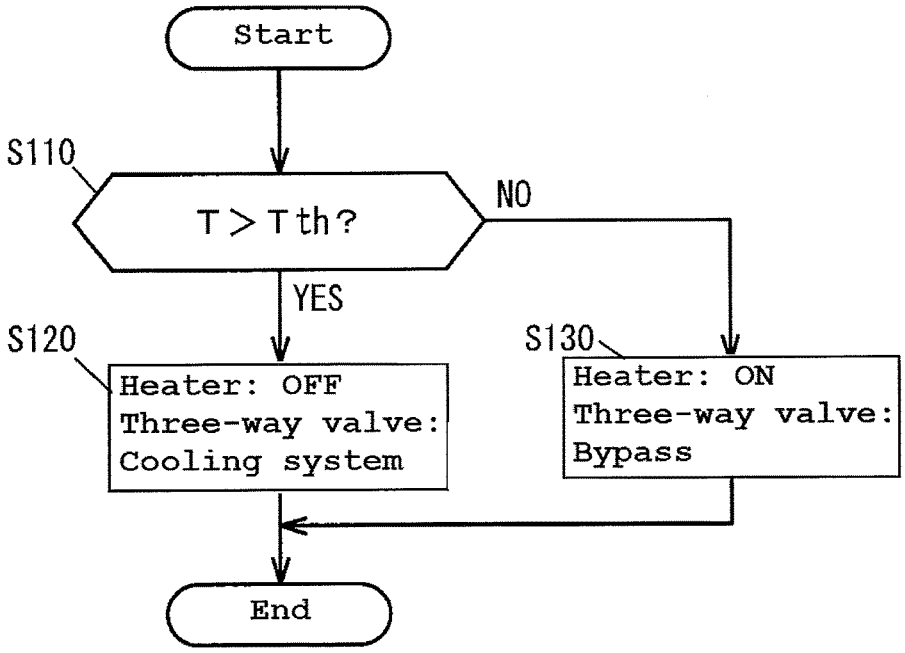
FIG. 6 is a flowchart showing an example of temperature regulation control in an embodiment of the present invention.

FIG. 6 is a flowchart showing an example of the temperature regulation control in the present embodiment. During the temperature regulation control, processing shown in FIG. 6 is repeatedly performed at a predetermined time interval in the temperature regulation controller 51. In step S110, whether the temperature T of the screw stator 24 is larger than a predetermined control temperature Tth is determined. The predetermined control temperature Tth is set to be equal to or higher than the sublimation temperature at a pressure during gas discharge in the screw groove pump section SP. For example, the predetermined control temperature Tth=the sublimation temperature is set. The temperature T of the screw stator 24 is calculated based on a temperature measured by the temperature sensor 43 by taking into consideration of heat resistance in a portion from the screw stator 24 through the temperature sensor 43. Further, a temperature value measured by the temperature sensor 43 may be used as the temperature T of the screw stator 24.

When T>Tth is determined in step S110, the temperature of the screw stator 24 enables the reaction product accumulation to be prevented. The temperature of a part of the rotor 30, the part facing the screw stator 24 (that is, the cylindrical section 30*b*), is substantially equal to or slightly higher than the temperature of the screw stator 24 because of heat transfer between the screw stator 24 and the cylindrical section 30*b*. As will be described below, the rotor temperature is required to be maintained lower than a temperature at which a creep phenomenon will be remarkable. Thus, it is not preferred to make the temperature of the screw stator 24 excessively high. Therefore, when T>Tth is determined in step S110, in order to prevent the temperature of the screw stator 24 from becoming too high, the processing proceeds to step S120 in which energization of the heater 42 is stopped, and the three-way valve 52 is switched to allow coolant to circulate through the spacer cooling pipe 45 and the base cooling pipe 46. As a result, the temperature of the screw stator 24 starts decreasing.

On the other hand, when NO (T≤Tth) is determined in step S110, the processing proceeds to step S130 in which energization of the heater 42 is started, and the three-way valve 52 is switched to divert coolant to the bypass pipe 53. Accordingly, circulation of the coolant in the spacer cooling pipe 45 and the base cooling pipe 46 is stopped, and the base 20 and the screw stator 24 which is in thermal contact with the base 20 are heated by the heater 42, so that the temperature of the screw stator 24 increases. The processing of FIG. 6 is repeatedly performed during the temperature regulation control, thereby maintaining the temperature T of the screw stator 24 around the predetermined control temperature Tth (temperature above the line L1 of FIG. 5) to prevent accumulation of the reaction product.

In the present embodiment, the cooling spacer 23*b* is provided, and the spacer cooling pipe 45 of the cooling spacer 23*b* and the base cooling pipe 46 are connected in series. The cooling spacer 23*b* is provided for cooling the stationary blades 22. In the turbo-molecular pump, the temperature of the rotor blades 30*a* and the temperature of the stationary blades 22 increase due to heat generation caused by gas discharge. In conventional turbo-molecular pumps provided with no cooling spacer 23*b*, heat of the rotor blades 30*a* is released to the coolant along a path in the order of the rotor blades 30*a*, the stationary blades 22, the spacers 23*a*, the base 20, and the base cooling pipe 46. On the other hand, the temperatures of the screw stator 24 and the base 20 during the temperature regulation control are maintained at a predetermined temperature (around the predetermined control temperature Tth). Therefore, the screw stator 24 and the stationary blades 22 have, for example, temperatures as shown in FIG. 7.

Figure 7:
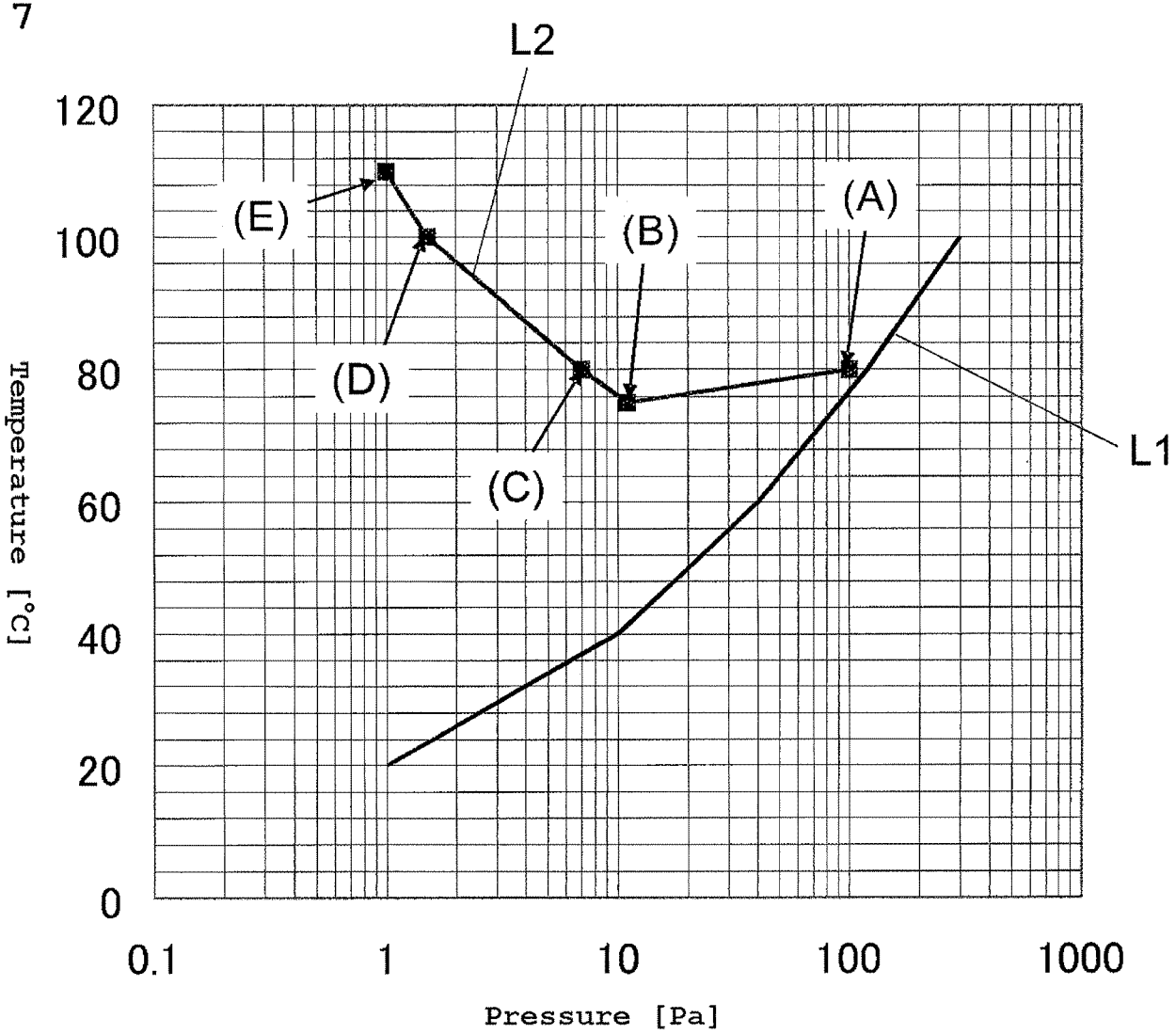
FIG. 7 is a diagram showing the temperatures of a screw stator 24 and stationary blades 22 and a sublimation temperature curve L1 when the cooling spacer 23*b* is not provided.

FIG. 7 shows the temperatures of the screw stator 24 and the stationary blades 22 (line L2) and the sublimation temperature curve L1. The pressures of the screw stator 24 and the stationary blades 22 are pressures during gas discharge. The pressure becomes lower in the order of a screw stator exist (A), a screw stator entrance (B), the lowest stationary blade 22 (C), an intermediate stationary blade 22 (D), and the highest stationary blade 22 (E). On the other hand, although the screw stator 24 is maintained at the predetermined temperature by the temperature regulation control, the temperature of the screw stator exit (A) is slightly higher than the temperature of the screw stator entrance (B) by heat of gas discharge. Further, a position farther from the screw stator 24 in the stationary blades 22 has a higher temperature. Thus, the temperature of the highest stationary blade 22 (E) is higher than 100° C. Further, the temperature of the rotor blades 33*a* is substantially equal to or higher than the temperature of the stationary blades 22.

Generally, the rotor 30 is formed of an aluminum alloy. A temperature at which a creep phenomenon occurs in aluminum is lower than that in other metals. Thus, in the turbo-molecular pump in which the rotor 30 rotates at high speed, it is necessary to suppress the rotor temperature lower than a creep temperature range. Accordingly, the flow rate of gas that can be discharged by the turbo-molecular pump is restricted by the rotor temperature. As a result, in the temperature condition shown in FIG. 7, it is not possible to further increase the gas flow rate.

Figure 8:
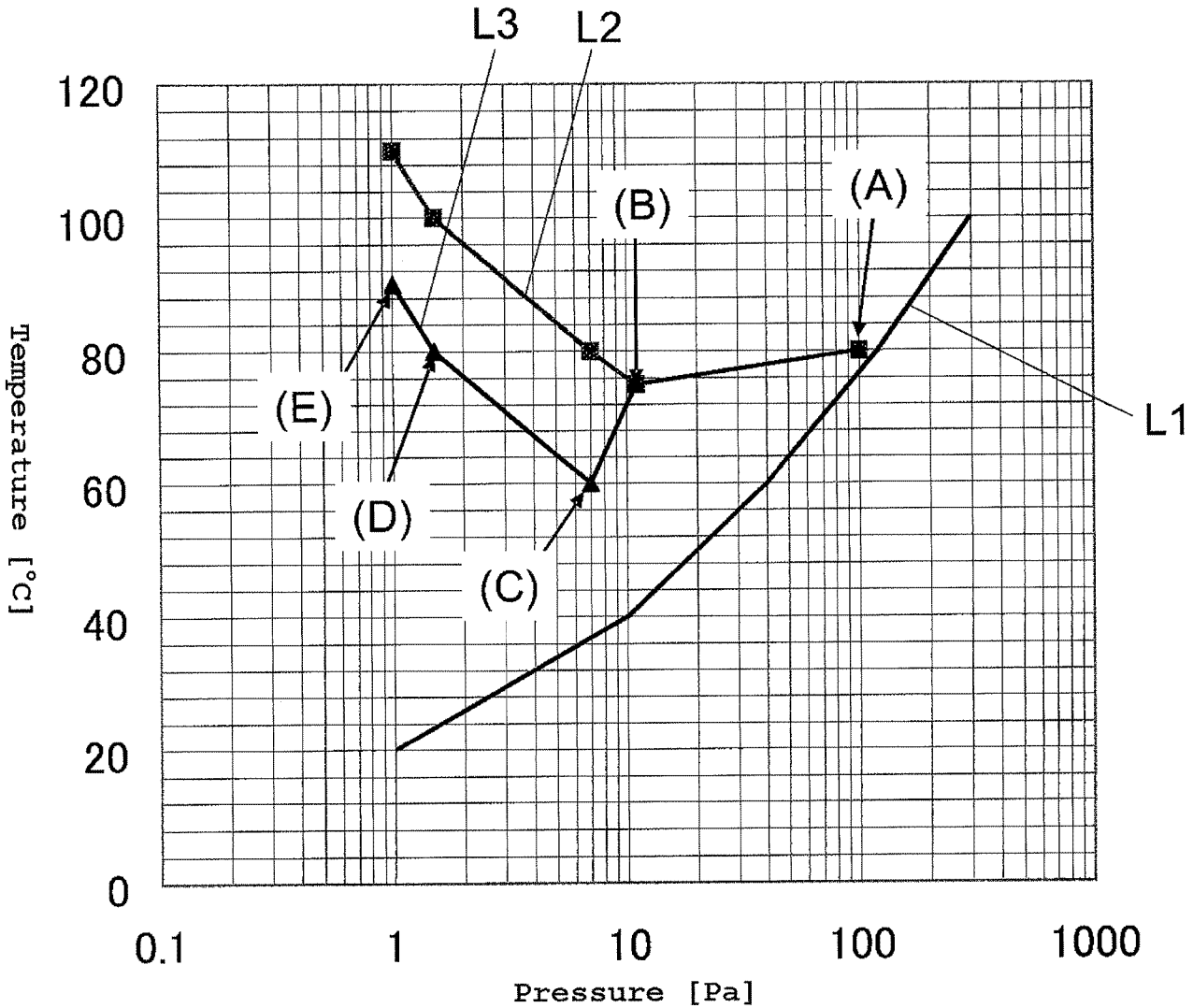
FIG. 8 is a diagram showing the temperatures of a screw stator 24 and stationary blades 22 and a sublimation temperature curve L1 in the embodiment of the present invention.

In view of the above, the cooling spacer 23*b* is provided to cool the stationary blades 22 in the present embodiment. FIG. 8 is a diagram showing the temperatures of the screw stator 24 and the stationary blades 22 (line L3) and the sublimation temperature curve L1 in the present embodiment. For the purpose of comparison, the line L2 shown in FIG. 7 is also illustrated. When the temperature regulation control is performed, the screw stator 24 is maintained at the predetermined temperature. Thus, also in the present embodiment, the temperature of the screw stator 24 is equal to the temperature shown in FIG. 7. However, the temperatures of the lowest stationary blade 22 (*c*), the intermediate stationary blade 22 (D), and the highest stationary blade 22 (E) become lower than the conventional line L2 as indicated by the line L3 by cooling performed by the cooling spacer 23*b*. As a result, a temperature margin of the rotor 30 with respect to creep deformation becomes larger, thereby making it possible to increase the gas flow rate and accelerate a CVD process or the like.

During the temperature regulation control, ON/OFF of the heater 42 and ON/OFF of circulation of coolant to the spacer cooling pipe 45 and the base cooling pipe 46 are synchronously performed as shown in FIG. 6. Thus, temperature distribution when the heater 24 is ON slightly differs from temperature distribution when the heater 24 is OFF. FIG. 8 shows temperature distribution when the heater 24 is ON and coolant is circulated.

The relationship between the mass Ms of the cooling spacer 23*b* and the mass Mb of the base 20 is apparently Mb>Ms, and the difference therebetween is considerably large. The spacer cooling pipe 45 and the base cooling pipe 46 are connected in series, and the flow velocity of coolant is thus constant in the spacer cooling pipe 45 and the base cooling pipe 46. Therefore, the heat transfer coefficient from the cooling spacer 23*b* to the coolant and the heat transfer coefficient from the base 20 to the coolant can be regarded as being substantially equal to each other. A difference in temperature between the spacer cooling pipe 45 and the coolant and a difference in temperature between the base cooling pipe 46 and the coolant can be regarded as being substantially equal to each other. Thus, heat transferred to the coolant from the spacer cooling pipe 45 per unit time and heat transferred to the coolant from the base cooling pipe 46 per unit time can be considered to be substantially equal to each other (assuming that the length of the spacer cooling pipe 45 and the length of the base cooling pipe 46 are substantially equal to each other).

As described above, Mb>Ms is satisfied. Thus, a temperature drop rate in the cooling spacer 23*b* when the coolant is circulated is higher than a temperature drop rate in the base 20 (that is, the screw stator 24). That is, the temperature of the stationary blades 22 is higher than the line L3 shown in FIG. 8 in a period in which the coolant is not circulated through the spacer cooling pipe 45 and the base cooling pipe 46 during the temperature regulation control, but promptly comes close to the line L3 when the three-way valve 52 is switched to start circulation of the coolant. Then, when the three-way valve 52 is switched to stop the circulation of the coolant, the temperature distribution of the stationary blades 22 moves upward from the position of the line L3. In other words, the line L3 slightly moves up and down in accordance with ON/OFF control of energization and coolant circulation during the temperature control.

Figure 9:
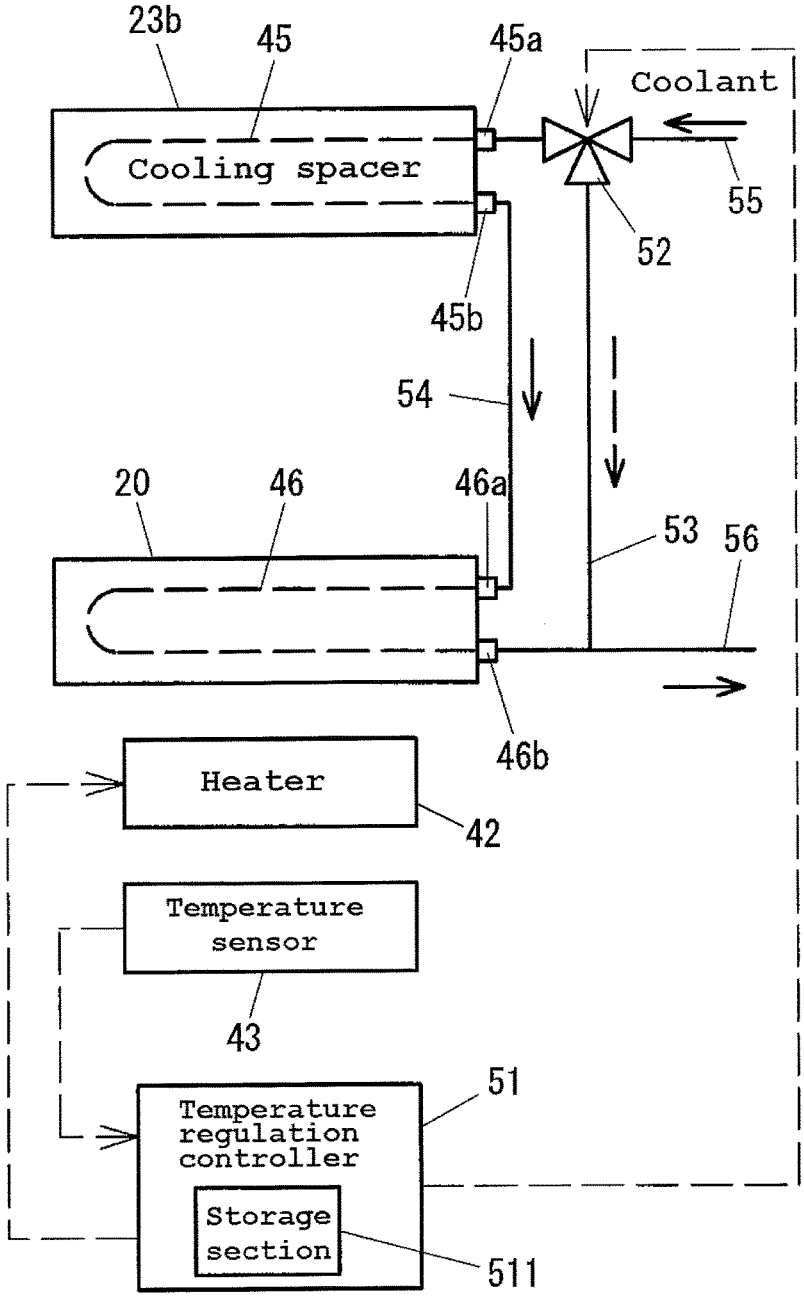
FIG. 9 is a block diagram illustrating the relationship between a temperature regulation system and a cooling spacer 23*b*.
Figure 10:
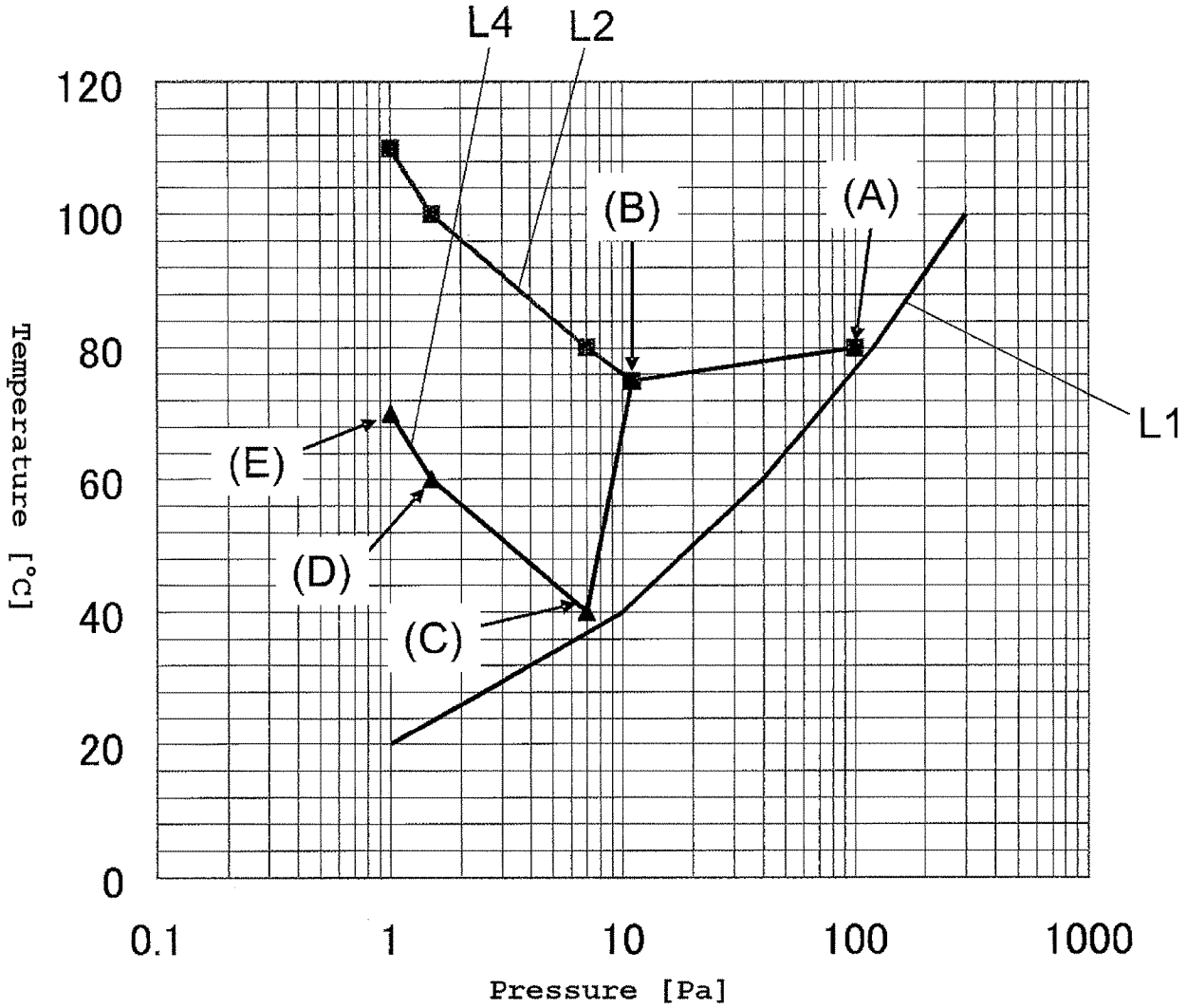
FIG. 10 is a diagram showing the temperatures of a screw stator 24 and stationary blades 22 and a sublimation temperature curve L1 in a modification.

FIGS. 9 and 10 are diagrams illustrating a modification of the present embodiment. FIG. 9 is a block diagram illustrating the relationship between a temperature regulation system and a cooling spacer 23*b*. FIG. 10 is a diagram showing the temperatures of a screw stator 24 and stationary blades 22 (line L4) and a sublimation temperature curve L1 in the modification. For the purpose of comparison, the line L2 is also illustrated. Hereinafter, differences from the configuration shown in FIG. 4 will be mainly described.

In the configuration shown in FIG. 9, a coolant supply pipe 55 provided with a three-way valve 52 is connected to an inflow section 45*a* of a spacer cooling pipe 45. An outflow section 45*b* of the spacer cooling pipe 45 is connected to an inflow section 46*a* of a base cooling pipe 46 thorough a pipe 54. A coolant return pipe 56 is connected to an outflow section 46*b* of the base cooling pipe 46. That is, in the modification, the coolant circulates from the cooling spacer 23*b* (the spacer cooling pipe 45) to the base cooling pipe 46.

In the configuration shown in FIG. 4, the coolant heated by the base cooling pipe 46 is supplied to the spacer cooling pipe 45. However, coolant flows in an opposite direction in FIG. 9. Thus, the temperature of the coolant supplied to the cooling spacer 23*b* is lower than that in the case of FIG. 4. Therefore, as indicated by the line L4 of FIG. 10, it is possible to make the temperatures of the cooling spacer 23*b* and the stationary blades 22 lower than those in the case of FIGS. 4 and 8. As a result, the temperature margin of the rotor 30 with respect to creep deformation becomes further larger, thereby making it possible to further increase the gas flow rate.

As described above, the line L3 (also the line L4) varies up and down by the ON/OFF control of coolant circulation during the temperature regulation control. However, on the other hand, an OFF period makes it possible to prevent the temperature of the stationary blades 22 from excessively decreasing. For example, when the spacer cooling pipe 45 is a separate system from coolant circulation of the base cooling pipe 46 and coolant is constantly circulated through the spacer cooling pipe 45, the temperature of the lowest stationary blade 22 (C) may drop lower than the sublimation temperature curve L1. In this case, a reaction product is disadvantageously accumulated on the lowest stationary blade 22 (C) and the cooling spacer 23*b*. However, it is possible to prevent the accumulation of the reaction product in the present embodiment.

In the above embodiment, when the circulation of coolant in the base cooling pipe 46 and the spacer cooling pipe 45 is stopped during the temperature regulation control, the coolant is diverted to the bypass pipe 53 using the three-way valve 52. Therefore, it is possible to prevent the coolant circulation from stopping in the cooling system of the entire apparatus. Generally, in a vacuum apparatus provided with a cooling system using coolant, an alarm is generated when circulation of the coolant stops. However, when the turbo-molecular pump of the present embodiment is used, an alarm is not generated during the temperature regulation. As a matter of course, a two-way valve may be used instead of the three-way valve to allow coolant to circulate and stop.

As described above, in the present embodiment, the turbo-molecular pump is provided with the rotor 30 which has the plurality of stages of rotor blades 30*a* and the cylindrical section 30*b*, the plurality of stages of stationary blades 22 which are alternately arranged with respect to the rotor blades 30*a*, the plurality of spacers 23*a* which are stacked to position the stationary blades 22, the screw stator 24 which is arranged with a gap from the cylindrical section 30*b*, the base 20 to which the screw stator 24 is fixed, the cooling spacer 23*b* which is arranged between the lowest spacer 23*a* and the base 20 so as to be in contact with the lowest spacer 23*a* of the stacked spacers 23*a* and has a first flow passage through which coolant flows, the heater 42 which heats the screw stator 24, the temperature sensor 43 which detects the temperature of the screw stator 24, the base cooling pipe 46 which forms a second flow passage connected in series to the spacer cooling pipe 45 as the first flow passage and cools the base 20, and the temperature regulation controller 51 as the temperature controller which controls circulation of coolant to the spacer cooling pipe 45 and the base cooling pipe 46 connected in series and energization of the heater 42 to maintain the temperature of the screw stator 24 at the predetermined temperature.

By controlling the circulation of coolant to the spacer cooling pipe 45 and the base cooling pipe 46 connected in series and the energization of the heater 42 to thereby maintain the temperature of the screw stator 24 at the predetermined temperature, the temperature of the screw stator 24 becomes higher than the sublimation temperature of the reaction product. Accordingly, it is possible to prevent accumulation of the reaction product. Further, providing the cooling spacer 23*b* for cooling the stationary blades 22 makes it possible to maintain the temperature of the stationary blades 22 lower than conventional one as indicated by the line L3 of FIG. 8, and thereby increase the gas flow rate. Further, performing ON/OFF of the coolant circulation in the spacer cooling pipe 45 makes it possible to prevent the stationary blades 22 from being excessively cooled, and thereby prevent the reaction product accumulation on the stationary blades 22.

Further, the coolant may circulate in the direction from the base cooling pipe 46 to the spacer cooling pipe 45, and may also circulate in the direction from the spacer cooling pipe 45 to the base cooling pipe 46. When the coolant circulates from the spacer cooling pipe 45 to the base cooling pipe 46, the temperature of the stationary blades 22 can be maintained further lower, thereby making it possible to further increase the gas flow rate.

Hereinabove, the embodiment and the modification have been described. However, the present invention is not limited thereto. Other modes conceivable within the technical idea of the present invention also fall within the scope of the present invention.

What is claimed is:

1. A turbo-molecular pump comprising:

a rotor having a plurality of stages of rotor blades and a cylindrical section;

a plurality of stages of stationary blades alternately arranged with respect to the plurality of stages of rotor blades;

a plurality of spacers stacked to position the plurality of stages of stationary blades;

a stator arranged with a gap from the cylindrical section, a base to which the stator is fixed;

a spacer cooling section arranged between a lowest spacer of the stacked spacers and the base, the spacer cooling section having a first flow passage through which coolant flows;

a heater for heating the stator;

a temperature sensor for detecting a temperature of the stator;

a base cooling section for cooling the base, the base cooling section having a second flow passage connected in series to the first flow passage; and a temperature controller for controlling circulation of coolant to the first flow passage and the second flow passage connected in series and energization of the heater to maintain the temperature of the stator at a predetermined temperature.

2. The turbo-molecular pump according to claim 1, wherein an outflow section of the second flow passage is connected to an inflow section of the first flow passage to allow coolant to circulate from the second flow passage to the first flow passage.

3. The turbo-molecular pump according to claim 1, wherein an outflow section of the first flow passage is connected to an inflow section of the second flow passage to allow coolant to circulate from the first flow passage to the second flow passage.

4. The turbo-molecular pump according to claim 1, further comprising:

a bypass pipe connected in parallel to the first flow passage and the second flow passage connected in series; and a three-way valve for alternatively switching a first circulation state in which coolant circulates to the first flow passage and the second flow passage and a second circulation state in which coolant circulates to the bypass pipe, wherein the temperature controller controls energization of the heater and switching between the first circulation state and the second circulation state performed by the three-way valve to maintain the temperature of the stator at the predetermined temperature.

* * * * *